US007803196B2

(12) United States Patent
Maruyama et al.

(10) Patent No.: US 7,803,196 B2
(45) **Date of Patent: *Sep. 28, 2010**

(54) METHOD FOR MODIFYING FIBERS

(75) Inventors: Naosuke Maruyama, Joetsu (JP); Kazuhisa Hayakawa, Joetsu (JP); Soji Tanioka, Tokyo (JP); Hidenori Tsuduki, Ichinomiya (JP); Tsuyoshi Shikano, Ichinomiya (JP); Hiroshi Kawamura, Ichinomiya (JP); Tsuneo Hayata, Ichinomiya (JP)

(73) Assignees: Aichi Prefectural Government, Nagoya-Shi (JP); Ichinomy Fashion Design Center Foundation, Ichinomiya-Shi (JP); Shin-Etsu Chemical Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/168,418

(22) Filed: Jun. 29, 2005

(65) Prior Publication Data

US 2006/0000028 A1 Jan. 5, 2006

(30) Foreign Application Priority Data

Jun. 30, 2004 (JP) ..... 2004-192517
Feb. 22, 2005 (JP) ..... 2005-045206
Jun. 9, 2005 (JP) ..... 2005-169335

(51) Int. Cl.
*D06M 23/00* (2006.01)
*D06M 11/00* (2006.01)
*D06M 13/00* (2006.01)
*C08B 1/00* (2006.01)

(52) U.S. Cl. ..... 8/129; 8/116.1; 536/56

(58) Field of Classification Search ..... 536/59, 536/85, 56; 8/129, 116.1
See application file for complete search history.

(56) References Cited

U.S. PATENT DOCUMENTS 2,253,297 A * 8/1941 Houghton et al. ..... 536/59
4,341,669 A 7/1982 Marco et al.
4,857,212 A * 8/1989 Ona et al. ..... 428/391
2004/0133990 A1 * 7/2004 Tanioka et al. ..... 8/115.51

FOREIGN PATENT DOCUMENTS

EP 0426304 A1 5/1991
EP 1120427 * 1/2001
GB 1492040 11/1977
JP 61-252369 A 11/1986
JP 2002-204951 * 7/2002
JP 2004-218102 A 8/2004

OTHER PUBLICATIONS

Rouette H-K., Encyclopedia of Textile Finishing, 2000, pp. 62-70 and 79-81.*
Hawley's Condensed Chemical Dictionary, 14th Edition, 2002, Web printout, 1page.*
Flick EW. Textile Finishing Chemicals, An industrial guide, 1990, p. 268.*
Fourne F. Synthetic Fibers, 1999, pp. 140-145.*
Kostrov et. al. Abstract, Khimicheskie Volokna, 1969, 4, 61.*
English language abstract of JP 2000095993 (Apr. 4, 2000).
English language abstract of JP 2003252724 (Sep. 10, 2003).

* cited by examiner

*Primary Examiner*—Shaojia Anna Jiang
*Assistant Examiner*—Scarlett Goon
(74) *Attorney, Agent, or Firm*—Birch, Stewart, Kolasch & Birch, LLP

(57) ABSTRACT

A method for modifying fibers is provided, which method comprises suspending and dispersing in water under shear force a cellulose ether having such a low degree of substitution that a molar degree of substitution with an alkyl group and/or a hydroxyalkyl group ranges from 0.05 to 1.3, applying the resulting dispersion and a crosslinking agent or an aqueous resin emulsion to fibers, and thermally treating the applied fibers.

16 Claims, No Drawings

METHOD FOR MODIFYING FIBERS

CROSS-REFERENCE TO RELATED APPLICATION

This non-provisional application claims priority under 35 U.S.C. §119(a) on Patent Application Nos. 2004-192517, 2005-045206 and 2005-169335 filed in Japan on Jun. 30, 2004, Feb. 22, 2005 and Jun. 9, 2005, respectively, the entire contents of which are hereby incorporated by reference.

BACKGROUND OF THE INVENTION

This invention relates to a method for modifying fibers.

For the purposes of preventing fibers from fluffing, improving tensile strength and wear resistance of fibers, imparting static resistance and water absorption to fibers, and providing good hand or texture of fibers such as smooth and dry feeling to fibers, there has been proposed a method called "imitation linen finishing" wherein viscose is attached to fibers and is coagulated and regenerated, followed by rinsing with water and drying to cover the fiber surfaces with regenerated cellulose.

In this connection, however, the method of modifying fibers by coverage with viscose-derived, regenerated fibers includes the steps of applying to fibers a solution, i.e., viscose, obtained by dissolving in a sodium hydroxide aqueous solution cellulose xanthate which is prepared by degenerating cellulose with highly toxic carbon disulfide, and subsequently coagulating and regenerating the cellulose. This presents a problem that in the steps of preparing cellulose xanthate and coagulating and regenerating the cellulose, workers undergo exposure to carbon disulfide. In addition, the regenerated cellulose per se used for the coverage according to this fiber modifying method is unsatisfactory with respect to water absorption, thus causing the problem in that improvements in static resistance, water absorption, shrink proofing are not satisfactory.

Further, with the "imitation linen finishing", an alkali aqueous solution is used, which needs the step of neutralization with an acid for coagulation, thus involving a difficulty in modifying fibers that are poor in resistance to alkali.

To solve the problem on the modification of fibers by coverage with viscose-derived, regenerated cellulose, a method of covering fiber surfaces with regenerated cellulose has been proposed. In the method, cellulose per se is dissolved in a sodium hydroxide aqueous solution and attached to fibers, followed by coagulation and regeneration (JP-A 61-252369).

However, this method needs not only the dissolution of cellulose in a sodium hydroxide aqueous solution at low temperature, but also the use of cellulose of the type which has a reduced degree of crystal structure sufficient to increase solubility, e.g. cellulose that is obtained by acid hydrolyzing wood pulp and grinding it in a ball mill, or regenerated cellulose that is prepared from viscose, thus imposing limitation on the method.

SUMMARY OF THE INVENTION

Accordingly, it is an object of the invention to provide a method for modifying fibers which is free of a problem on toxicity based on carbon disulfide, allows an easy manufacturing process and enables fibers having a poor resistance to alkali to be modified.

It is another object of the invention to provide a method for modifying fibers so that the resulting fibers can be prevented from fluffing and has excellent tensile strength, wear resistance, static resistance, water absorption and washing resistance.

There has already been proposed a method wherein a cellulose ether having a low degree of substitution is dissolved in a solution of an alkali such as sodium hydroxide typically having a concentration of about 10% by weight and applied onto fibers, after which the solution is coagulated and regenerated (JP-A 2004-218102). Further intensive studies have been made and, as a result, a method of modifying fibers has been found wherein a dispersion is prepared by suspending and dispersing a cellulose ether having such a low degree of substitution that a molar degree of substitution with an alkyl group and/or a hydroxyalkyl group ranges from 0.05 to 1.3 in water or a dilute alkali aqueous solution having a concentration of an alkali of 1% by weight or less and subsequently subjecting to shear force, and the dispersion is applied onto fibers along with a crosslinking agent and/or an aqueous resin emulsion, followed by thermal treatment. In this method, an alkali aqueous solution having a high alkali concentration is not used and thus, the step of neutralization and coagulation with an acid is not needed, so that the method enables one to modify fibers that are low in alkali resistance as will be difficult in handling with "imitation linen finishing" where an aqueous solution of an alkali such as sodium hydroxide having a high concentration is usually used. Moreover, it has been found that fiber modification finishing is enabled without a problem on carbon disulfide to provide modified fibers that can be prevented from fluffing and have improved tensile strength and excellent wear resistance, static resistance, water absorption and washing resistance. The invention has been accomplished based on these findings.

According to the invention, there is provided a method for modifying fibers comprising steps of suspending and dispersing a cellulose ether having such a low degree of substitution that a molar degree of substitution with an alkyl group and/or a hydroxyalkyl group ranges from 0.05 to 1.3 in water or a dilute alkali aqueous solution having a concentration of an alkali of 1% by weight or less under shear force, applying the resulting dispersion and a crosslinking agent or an aqueous resin emulsion to fibers, and thermally treating the dispersion-applied fibers.

In this case, the crosslinking agent is preferably an isocyanate compound, and the aqueous resin emulsion is preferably an aqueous urethane resin emulsion or an O/W emulsion of a reactive organopolysiloxane. Moreover, the low-substituted cellulose ether should preferably be a low-substituted hydroxypropyl cellulose having a molar degree of substitution of 0.1 to 0.7.

In the method for modifying fibers wherein the dispersion of the low-substituted cellulose ether in water or the dilute alkali aqueous solution by application of a shear force thereto may be prepared by a method wherein dispersed particles in a low-substituted cellulose ether dispersion to be sheared are caused to mutually collide or to collide against a collision plate for grinding, using a vibration ball mill, colloid mill, homomixer or homogenizer. In this case, it is preferred that the low-substituted cellulose ether is dissolved in an aqueous solution of an alkali, and the solution is neutralized with an equivalent of an acid or such an amount of an acid that the solution having a concentration of an alkali of 1% by weight or less is obtained, thereby settling the low-substituted cellulose ether to prepare the low-substituted cellulose ether dispersion to be sheared. The dispersion of the low-substituted cellulose ether in water or the dilute alkali aqueous solution by application of a shear force thereto may also be prepared by a method wherein the low-substituted cellulose ether is dissolved in an alkali aqueous solution having a concentration of an alkali of 2% by weight or more and the alkali solution is milled under shear by means of a colloid mill or ground through collision by use of a homogenizer, while the solution is neutralized with an equivalent of an acid or such an amount of an acid that the solution having a concentration of an alkali of 1% by weight or less is obtained.

Preferably, a low-substituted cellulose ether dispersion to be sheared is injected from a nozzle with a pressure of 70 to 250 MPa so that the low-substituted cellulose ether dispersion to be sheared is caused to mutually collide or collide against a collision plate with an angle of collision of 90 to 180° and the number of collision of 1 to 200 sufficient to cause the particles of the low-substituted cellulose ether to be so fine that an average length thereof is reduced at ¼ or below, thereby obtaining the sheared low-substituted cellulose ether dispersion. Alternatively, particles of the low-substituted cellulose ether may be ground by milling a low-substituted cellulose ether dispersion to be sheared with a shear force of at least 500 $sec^{-1}$ one time to 60 times, thereby obtaining the sheared low-substituted cellulose ether dispersion shear force thereto. The concentration of the low-substituted cellulose ether in the sheared dispersion preferably ranges from 0.5 to 20% by weight, and the sheared low-substituted cellulose ether dispersion is applied to fibers in such an amount that a pickup ranges 10 to 500% by weight.

According to the method of the invention, fibers can be modified without use of a noxious solvent such as carbon disulfide, so that high safety is ensured and a fabrication process is not complicated. The resulting modified fibers are unlikely to suffer fluffing, are improved in tensile strength and are excellent in wear resistance, static resistance, water absorption and washing resistance. When compared with conventional "imitation linen finishing", modification is possible using a simpler procedure, with the attendant advantage in that fibers having a low resistance to alkali can be modified.

DETAILED DESCRIPTION OF THE PREFERRED EMBODIMENTS

The fibers used in the invention are not critical in type. Examples of the fibers include synthetic fibers such as polyethylene fibers, polypropylene fibers, polyester fibers, nylon fibers, acrylic fibers, vinylon fibers, rayon fibers, polyvinyl chloride fibers, and polyvinylidene chloride fibers; natural fibers such as of cotton, cellulose, and hemp; and animal fibers such as wool, silk, and cashmere. In the present invention, animal fibers that are less resistant to alkali, e.g. wool, silk, and cashmere, and blends of polyesters and wool may also be used appropriately. The term "fibers" used herein includes thread or yarn-shaped fibers, i.e., threads, woven fabrics or textiles of thread-shaped fibers, or non-woven fabrics or textiles of thread-shaped fibers.

The cellulose ether having a low degree of substitution used in the invention means a cellulose ether wherein the hydrogen atoms of the hydroxyl groups of glucose rings of cellulose are substituted with an alkyl group and/or a hydroxyalkyl group provided that a molar degree of substitution ranges from 0.05 to 1.3, preferably from 0.1 to 0.7. The cellulose ether should not be dissolved in water but is able to provide a dispersion of high stability when undergoing high shear force. If the molar degree of substitution is lower than 0.05, such a cellulose ether may not provide a stable dispersion when applied with shear force. On the contrary, when the molar degree exceeds 1.3, dissolution in water increases with the possibility that washing resistance lowers.

In the present specification, the cellulose ether of a low degree of substitution is referred as a low-substituted cellulose ether hereinafter.

Examples of such a cellulose ether of a low degree of substitution include low-substituted alkyl celluloses such as low-substituted methyl cellulose, and low-substituted ethyl cellulose; low-substituted hydroxyalkyl celluloses such as low-substituted hydroxyethyl cellulose, and low-substituted hydroxypropyl cellulose; low-substituted hydroxyalkylalkyl celluloses such as low-substituted hydroxypropylmethyl cellulose, low-substituted hydroxyethylmethyl cellulose, and low-substituted hydroxyethylethyl cellulose. Of these, low-substituted hydroxypropyl cellulose is preferred.

The modification of fibers according to the invention is carried out by a procedure which includes suspending or dispersing such a low-substituted cellulose ether as set out hereinabove in water or a dilute alkali aqueous solution having a concentration of an alkali of 1% by weight or less under shear force, applying the sheared dispersion to fibers by coating or dipping, if necessary, removing an excessive dispersion applied to the fibers by means of a centrifugal dehydrator, a mangle, a knife coater or the like, and drying the attached fibers.

In the present specification, the low-substituted cellulose ether dispersion before shearing is referred as a dispersion to be shear, and the low-substituted cellulose ether dispersion after shearing is referred as a sheared dispersion hereinafter.

The low-substituted cellulose ether dispersion to be sheared can be obtained by adding to and dispersing in water or a dilute alkali aqueous solution having a concentration of an alkali such as sodium hydroxide or potassium hydroxide of 1% by weight or less, especially 0.5% by weight or less. The dispersion to be sheared can also be obtained by dissolving the low-substituted cellulose ether in an alkali solution having a concentration of an alkali such as sodium hydroxide or potassium hydroxide of 2 to 25% by weight, especially 3 to 15% by weight, and neutralizing the alkali solution with an equivalent of an acid or such an amount of an acid that a dilute alkali aqueous solution having a concentration of an acid of 1% by weight or less can be obtained, thereby settling the low-substituted cellulose ether in the solution.

For the dispersion of a low-substituted cellulose ether in water or the dilute alkali aqueous solution by application of a shear force thereto, a method wherein dispersed particles in the low-substituted cellulose ether dispersion to be sheared are caused to mutually collide for grinding the particles, or a method wherein the particles are caused to collide against a collision plate for milling and grinding the particles can be employed, although the method is not limited thereto. Devices of preparing the sheared low-substituted cellulose ether dispersion through mutual collision of the particles of the low-substituted cellulose ether dispersion to be sheared or by collision against a collision plate are not critical in type and include, for example, vibration ball mills, colloid mills, homomixers, homogenizers and the like. They are commercially available. For example, as a colloid mill, MASSCOLLOIDER or CERENDIPITOR made by Masuko Sangyo Co., Ltd. may be used. From the standpoint of preparing a uniform sheared dispersion, preferred homogenizers are those wherein a dispersion to be sheared is jetted from a valve orifice under high pressure to subject the low-substituted cellulose ester to frictional collision and which include "HOMOGENIZER" made by Sanwa Machine Co., Inc., "ULTIMIZER SYSTEM" made by Sugino Machine Ltd., "MICROFLUIDIZER" made by Mizuho Industrial Co., Ltd., "HIGH PRESSURE HOMOGZENIZER" made by Gaulin, and the like, ultrasonic homogenizers using supersonic vibrations such as "ULTRASONIC HOMOGEMIZER" made by Nippon Seiki Co., Ltd., and the like. The sheared dispersions repeatedly treated by these devices may also be used.

Further, for preparing the sheared dispersion, as described in JP-A 2002-204951, a low-substituted cellulose ether may be dissolved in an aqueous solution of an alkali such as sodium hydroxide or potassium hydroxide having a concentration of an alkali of 2 to 25% by weight, especially 3 to 15% by weight and the alkali solution is milled under shear by means of a colloid mill or ground through collision by use of such a homogenizer as mentioned above, while the solution is neutralized with an equivalent of an acid (such as hydrochloric acid, sulfuric acid or the like) or such an amount of an acid that the solution having a concentration of an alkali of 1% by weight or less is obtained, thereby obtaining a sheared dispersion.

The collision of low-substituted cellulose ether can be conducted as follows.

The low-substituted cellulose ether dispersions to be sheared are injected from each nozzle at a pressure of 10 to 250 MPa so that the dispersions to be sheared mutually collide with an angle of collision of 90 to 180°, preferably 95 to 178°, more preferably 100 to 170°. Alternatively, the low-substituted cellulose ether dispersion to be sheared is injected from a nozzle at a pressure of 70 to 250 MPa so that the dispersion to be sheared collides against a collision plate with an angle of collision of 90 to 180°, preferably 95 to 178°, more preferably 100 to 120°. The number of collisions should preferably be 1 to 200, especially 5 to 120. The collisions should preferably be conducted so that it is sufficient to cause the particles of the low-substituted cellulose ether to be so fine that an average length thereof is reduced at ¼ or below, preferably ⅕ to 1/100, more preferably ⅙ to 1/50, most preferably 1/7 to 1/20. The average length can be obtained as an average value of the length-measuring results for at least 50 particles of the low-substituted cellulose ether in a microphotograph of a polarization microscope or a transmission electromicroscope. Outside the ranges of the pressure, the angle of collision and the number of collisions, satisfactory, uniform dispersion may not be ensured and the molecular weight of low-substituted cellulose may lower extremely, with the possibility that a satisfactory effect of improving the hand or texture of the cellulose cannot be obtained.

Where the low-substituted cellulose ether is dispersed by milling, it is preferred to mill the low-substituted cellulose ether so that a dispersion to be sheared is applied with a shear force of at least 500 $sec^{-1}$, preferably at least 1,000 $sec^{-1}$, more preferably at least 1,500 $sec^{-1}$. The shear force may be applied repeatedly or continuously, and the number of the application of the shear force is preferably 1 to 60, more preferably 10 to 60. Less than one time, the degree of dispersion would be insufficient, resulting in lowering the film-forming property of the low-substituted cellulose ether. More than 60 times would cause the reduction of polymerization degree of the low-substituted cellulose ether, resulting in lowering the film strength.

On the other hand, the concentration of the low-substituted cellulose ether in the sheared dispersion ranges from 0.5 to 20% by weight, preferably from 1 to 10% by weight. If the concentration is smaller than 0.5% by weight, no or little effect of improving the hand of fibers is expected. When the concentration exceeds 20% by weight, the sheared dispersion becomes so high in viscosity that it is unlikely to realize a given amount of the cellulose ether being applied to fibers.

The coating or application of low-substituted cellulose ether dispersion may be carried out using coaters such as a one-thread sizing machine, a blade coater, a transfer coater, and an air doctor coater, or using dipping machines such as of a pre-wet type, a float type, and a doctor bar type to dip fibers in the sheared dispersion. After completion of coating operations, the fibers are dried at approximately 100° C. to obtain a fiber product improved in hand or texture suited for the purpose of the invention.

The amount of the sheared low-substituted cellulose ether dispersion attached to fibers is appropriately determined, and a pickup, i.e., (weight of an applied sheared low-substituted cellulose ether dispersion/weight of fiber substrate)×100, ranges 10 to 500% by weight, preferably 20 to 300% by weight. When the pickup is smaller than 10% by weight, a coverage of fibers with the low-substituted cellulose ether becomes small, with the possibility that the fibers are not improved satisfactorily. On the contrary, when the pickup exceeds 500% by weight, the hand of the resulting fibers become worsened and the improvements in air permeability and hands such as a smooth feeling may not be attained to such an extent as to match too large an amount used.

The low-substituted cellulose ether is fixed to fibers through the drying as mentioned hereinbefore. In the practice of the invention, a crosslinking agent or an aqueous resin emulsion is applied onto the fibers simultaneously with or after the application of the sheared dispersion on the fibers, followed by drying and thermal treating to cause a crosslinking reaction to occur with the aid of the crosslinking agent or cause the aqueous resin emulsion to be converted to a cured film. Eventually, the resulting fibers are improved in washing resistance. In this connection, the crosslinking reaction and the conversion of the aqueous resin emulsion into the cured film are caused to proceed during the heating step. Either of the crosslinking reaction or the conversion of the resin emulsion into the cured film contributes to enhancing the adhesion between the fibers and the low-substituted cellulose ether, thereby improving the washing resistance.

The crosslinking agents used in the invention may be any ones which undergo a reaction with hydroxyl groups left in the molecule of the cellulose ether thereby causing crosslinking reaction. Such crosslinking agents are those agents capable of reaction with hydroxyl group as described in HANDBOOK OF CROSSLINKING AGENTS (published by Taiseisha Co., Ltd., Oct. 20, 1981). Specific examples include: epoxy compounds such as ethylene glycol diglycidyl ether, propylene glycol diglycidyl ether, glycerol polyglycidyl ether, diglycerol polyglycidyl ether, sorbitol polyglycidyl ether, allyl glycidyl ether, butyl glycidyl ether, phenyl glycidyl ether, alkylphenol glycidyl ethers, polyethylene glycol diglycidyl ether, tripropylene glycol diglycidyl ether, neopentyl glycidyl ether, 1,6-hexanediol, diglycidyl ether, glycerine polyglycidyl ether, diglycerine polyglycidyl ether, cresyl glycidyl ether, aliphatic diglycidyl ethers having 3 to 15 carbon atoms, monoglycidyl ether, epoxy acrylate, bisphenol A, butylglycidyl ether acrylate, ethylene glycol diglycidyl ether acrylate, trimethylolpropane polyglycidyl ether polyacrylate, terephthalic acid diglycidyl ether acrylate, phthalic acid diglycidyl ester, spiroglycol diglycidyl ether and the like; dialdehydes such as glyoxal; formaldehyde crosslinking agents such as urea formaldehyde; and isocyanate crosslinking agents such as toluidine isocyanate, dimer of 2,4-toluidine isocyanate, naphthalene-1,5-diisocyanate, o-toluidine isocyanate, diphenylmethane diisocyanate, triphenylmethane triisocyanate, tris-(p-isocyanatephenyl)thiophosphite, polymethylenephenyl isocyanate, polyfunctional aromatic isocyanates, aromatic polyisocyanates, hexamethylene diisocyanate, trimethylhexamethylene diisocyanate, isophorone diisocyanate, blocked polyisocyanates, xylylene diisocyanate, ether group and urethane group-bearing, blocked isocyanate-containing prepolymers, polyisocyanate prepolymers, blocked isocyanates, polyisocyanates, two-component polyisocyanates, yellowing-free, two-component polyisocyanates, thermosetting polyisocyanates and the like. Moreover, there may be mentioned silanes of the general formula $SiR^1R^2R^3R^4$ wherein $R^1$ represents an alkyl group, an alkoxy group or an acyloxy group each having 1 or 2 carbon atoms, and $R^2$, $R^3$ and $R^4$ independently represent an alkoxy group or an acyloxy group having 1 or 2 carbon atoms.

It will be noted that the concentration of these crosslinking agents in the sheared low-substituted cellulose ether dispersion is not limited and is preferably within a range of from 1 to 30% by weight, especially 5 to 10% by weight. If the concentration is smaller than 1% by weight, a washing resistance may not be improved satisfactorily. When the concentration exceeds 30% by weight, there is the possibility that a further improvement in washing resistance is not expected.

A method for the purpose to improve the washing resistance with the crosslinking agent, there can be used a method wherein a crosslinking agent is added to a sheared low-substituted cellulose ether dispersion obtained by milling under collision or shear force. The resulting sheared dispersion is applied to fibers, dried and heated at a temperature of 100 to 170° C. Alternatively, after coating with the sheared low-substituted cellulose ether dispersion, the coated fibers may be immersed in a crosslinking solution, dried after removal of an excessive crosslinking solution by means of a centrifugal dehydrator, a mangle, a knife coater or the like, heated to 100 to 170° C. for crosslinking reaction, and dried to obtain final fibers whose hand or texture is improved. It will be noted that in any case, the heating time is preferably within a range of 1 to 20 minutes.

In this connection, in order to permit a crosslinking agent to be readily infiltrated into fibers, surface active agents including alkyl ether penetrants such as propylene glycol, ethylene glycol and the like, and penetrants of block copolymers of propylene glycol and ethylene glycol may be added in an amount of 0.5 to 1% by weight along with a crosslinking agent.

For the aqueous resin emulsion used in the invention, there may be used any ones which act to improve adhesion between fibers and a low-substituted cellulose ether in the following way. The aqueous resin in the emulsion is fixed on fibers along with a low-substituted cellulose ether during the course of drying of the sheared low-substituted cellulose ether dispersion and converted into a cured film of the aqueous resin emulsion in the course of a subsequent heating step so that the fiber surfaces are covered with the film along with the low-substituted cellulose ether to improve the washing resistance. For this purpose, aqueous resin emulsions ordinarily used for resin finishing of fibers may be used including aqueous urethane resin emulsions, aqueous acrylic resin emulsions, aqueous vinyl acetate resin emulsions, aqueous ethylene/vinyl acetate emulsions, aqueous epoxy resin emulsions, O/W emulsions of reactive organopolysiloxanes, SBR latices and the like. Of these, aqueous urethane resin emulsions and O/W emulsions of reactive organopolysiloxanes are preferred.

The aqueous urethane resin emulsions include various types of emulsions prepared by reaction between polyethers such as polyoxyethylene glycol, polyoxypropylene glycol and polyoxybutylene glycol; and diisocyanates such as trolylene diisocyanate, 3,3'-bistolylene4,4'-diisocyanate, diphenylmethane diisocyanate, 3,3-dimetyldiphenylmethane diisocyanate and 4,4'-diisocyanate.

For the O/W emulsions of reactive organopolysiloxanes, mention is made of those emulsions obtained by dispersing in water methylhydrogen-polysiloxane, terminal hydroxyl group-blocked dimethylpolysiloxane and vinyl group-containing polysiloxane that are described in U.S. Pat. No. 4,221,688 and SILICONE HANDBOOK, edited by Kunio Ito (published by Nikkan Kogyo Shimbun Ltd., on Aug. 31, 1990) and organopolysiloxanes having at least two hydroxyl groups bonded to a silicon atoms as described in JP-B 3-67145. For a catalyst of promoting the crosslinking reaction of these reactive organopolysiloxanes in the form of the O/W emulsion, there may be used salts of metals such as tin, lead, zinc, cobalt, manganese chromium, zirconium, titanium, and platinum. Especially, zirconium acetate as described in JP-B 34-4199 and chloroplatinic acid as described in JP-B 51-9440 are favorably used. The amount of the catalyst is not limited and an effective amount for promoting the crosslinking reaction is within a range of 0.001 to 120 parts by weight, preferably 0.005 to 110 parts by weight per 100 parts by weight of reactive organopolysiloxane in an emulsion used. The particle size in the O/W emulsion is not limited and is within a range of from 0.01 to 100 μm, preferably from 0.1 to 80 μm in view of stability thereof.

For coverage of fibers with a cured film of the aqueous resin and integrally with a low-substituted cellulose ether, there may be used a method wherein an aqueous resin emulsion is added to the sheared low-substituted cellulose ether dispersion and applied onto fibers along with the low-substituted cellulose ether upon coating of the cellulose ether onto the fibers, followed by heating to convert the aqueous resin into a cured film. Alternatively, the sheared low-substituted cellulose ether dispersion is applied onto fibers and dried. Then, the resulting fibers are immersed in an aqueous resin emulsion, followed by heating to convert the aqueous resin into a cured film. In this case, the heating conditions may be those conditions sufficient to cause the aqueous resin emulsion to be converted to a cured film and preferably include a heating temperature of 80 to 150° C. and a heating time of 1 to 20 minutes. It is to be noted that the concentration of the aqueous resin in the sheared low-substituted cellulose ether dispersion is not limited, and is preferably in the range of 1 to 30% by weight, more preferably 5 to 10% by weight. If the concentration is smaller than 1% by weight, a satisfactory improvement in washing resistance is not obtained. On the other hand, when the concentration exceeds 30% by weight, any further improvement in washing resistance cannot be expected.

The clothes and fabrics made from threads obtained from the modified fibers of the invention are improved in air permeability and have a smooth feeling and flexibility. If titanium oxide is added to a sheared low-substituted cellulose ether dispersion in an amount of about 1 to 20% by weight, fibers or clothes having photocatalytic function can be obtained. Alternatively, dyes or pigments may be added to a sheared low-substituted cellulose ether dispersion for coloration. Besides, all types of inorganic materials, organic material, and natural materials may be added to a sheared low-substituted cellulose ether dispersion within ranges of amounts not impeding the purposes of the invention, fibers modified as desired may be obtained.

EXAMPLES

Examples are shown to illustrate the invention, which should not be construed as limiting the invention thereto. Comparative examples are also shown. It will be noted that in the following examples and comparative example, a degree of substitution of cellulose ether means a molar degree of substitution unless otherwise indicated.

Example 1

50 g of low-substituted celluloses ethers indicated in Table 1 was dispersed in 950 g of 0.5 wt % sodium hydroxide aqueous solution, followed by subjecting the dispersion to be sheared to high pressure dispersion at a pressure of 150 MPa by use of an opposed, collision unit of "ALTEMIZER", made by Sugino Machine Ltd. This high pressure dispersion procedure was repeated ten times to prepare a sheared low-substituted cellulose ether dispersion. 8 g of diphenylmethane diisocyanate was added to 100 g of each sheared dispersion to prepare a sample dispersion. Next, Knit Comber cotton thread #30/1 was dipped in this dispersion and squeezed by means of a roller mangle to a pickup of 108%, followed by drying and then heating at 145° C. for 10 minutes to obtain a sample.

The samples obtained in this way were each subjected to the following testing methods to assess a fluffing property, tensile strength, wear resistance, static resistance, water absorption and washing resistance. The results are shown in Table 1.

Examples 2 to 8

50 g of low-substituted celluloses ethers indicated in Table 1 was dispersed in 950 g of water, followed by subjecting the dispersion to be sheared to high pressure dispersion at a pressure of 150 MPa by use of an opposed, collision unit of "ALTEMIZER", made by Sugino Machine Ltd. This high pressure dispersion procedure was repeated ten times to prepare a sheared low-substituted cellulose ether dispersion. 8 g of diphenylmethane diisocyanate was added to 100 g of each sheared dispersion to prepare a sample dispersion. Next, Knit Comber cotton thread #30/1 or wool #2/48 was dipped in this dispersion and squeezed by means of a roller mangle to a pickup of 108%, followed by drying and then heating at 145° C. for 10 minutes to obtain a sample.

The samples obtained in this way were each subjected to the following testing methods to assess a fluffing property, tensile strength, wear resistance, static resistance, water absorption and washing resistance. The results are shown in Table 1.

Example 9

50 g of a low-substituted cellulose ether indicated in Table 1 was dispersed in 950 g of water, followed by subjecting the dispersion to be sheared to high pressure dispersion at a pressure of 150 MPa by means of an opposed, collision unit of "ALTEMIZER", made by Sugino Machine Ltd. This procedure was repeated ten times to provide a sheared low-substituted cellulose ether dispersion. 8 g of a crosslinked product of polyoxyethylene glycol and diphenylmethane diisocyanate was added, as an aqueous urethane resin emulsion of a crosslinking type, to 100 g of the sheared dispersion to prepare a sample dispersion. Next, wool #2/48 was immersed in the dispersion and squeezed to a pickup of 108% by means of a roller mangle, followed by heating at 95° C. for 20 minutes. The thus obtained sample was subjected to the following testing methods with the results of evaluation shown in Table 1.

Example 10

50 g of low-substituted celluloses ethers indicated in Table 1 was dispersed in 950 g of 0.5 wt % sodium hydroxide aqueous solution, followed by subjecting the dispersion to be sheared to high pressure dispersion at a pressure of 150 MPa by use of an opposed, collision unit of "ALTEMIZER", made by Sugino Machine Ltd. This high pressure dispersion procedure was repeated ten times to prepare a sheared low-substituted cellulose ether dispersion. 8 g of diphenylmethane diisocyanate was added to 100 g of each sheared dispersion to prepare a sample dispersion. Next, wool #2/48 was dipped in this dispersion and squeezed by means of a roller mangle to a pickup of 108%, followed by drying and then heating at 145° C. for 10 minutes to obtain a sample.

The samples obtained in this way were each subjected to the following testing methods to assess a fluffing property, tensile strength, wear resistance, static resistance, water absorption and washing resistance. The results are shown in Table 1.

Examples 11 to 13

50 g of low-substituted celluloses ethers indicated in Table 1 was dispersed in 950 g of water, followed by subjecting the dispersion to be sheared to high pressure dispersion at a pressure of 150 MPa by use of an opposed, collision unit of "ALTEMIZER", made by Sugino Machine Ltd. This high pressure dispersion procedure was repeated ten times to prepare a sheared low-substituted cellulose ether dispersion. 8 g of diphenylmethane diisocyanate was added to 100 g of each sheared dispersion to prepare a sample dispersion. Next, a blended thread of polyester and wool, each with a yarn count of #2/60 was dipped in this dispersion and squeezed by means of a roller mangle to a pickup of 108%, followed by drying and then heating at 145° C. for 10 minutes to obtain a sample. The sample obtained in this way was assessed according to the following testing methods, with the results shown in Table 1.

Comparative Example 1

Wool #2/48 was immersed in a viscose sample solution included of 8% by weight, calculated as cellulose, of powdery cellulose KC Floc W 100 made by Nippon paper Industries Co., ltd., 6% by weight of sodium hydroxide and 2.5% by weight of carbon disulfide. As a result, it was found that the wool was dissolved out, disenabling the wool to be modified.

Comparative Example 2

50 g of a cellulose ether having a low degree of substitution with a hydroxypropyl group of 0.25 was dispersed in 475 g of water, to which 475 g of 20 wt % sodium hydroxide solution to prepare a sodium hydroxide aqueous solution of the cellulose ether. A blended thread of polyester and wool, each with a yarn count of #2/60, was immersed in the solution. As a result, it was found that the blended thread was dissolved out, thus disenabling the thread to be modified.

Fluffing Property

Using Optical Fluffing Tester, F-INDEX TESTER, made by Shikibo Ltd., a ratio of a total weight of fluffs having levels of 2 mm or below, 3 mm or below and 4 mm or below to an initial weight of a non-treated thread was determined.

Tensile Strength

Using a Tesilon tensile strength tester, made by A&D Co., Ltd., ten threads having a length of 100 mm was subjected to measurement of tensile strength to calculate a ratio to that of non-treated threads.

Wear Resistance

Hiruta's wear resistance tester was used to determine a number of cycles before a sample thread was broken, from which a value obtained by dividing the number by a number of cycles before breakage of a non-treated thread is calculated.

Static Resistance

A half life was measured according to the method of JIS L 1094-1980 to determine a static resistance as a ratio to that of a non-treated thread.

Water Absorption Rate

According to the method of JIS L 1096-1979, a length of water absorption in ten minutes was measured to determine a ratio to that of a non-treated thread.

Washing Resistance

A test thread was washed according to a method described in JIS L 0844 and, after the washing, was microscopically observed. When fluffing was more significantly lessened in degree than that of a non-treated one, such a modified thread was assessed as "◎".

TABLE 1

| Target fiber | | Name and Molar Degree of Substitution of Low-substituted Cellulose Ether: Name | Methyl group | Hydroxy-propoxy group | Evaluation: Ratio in Fluffing Degree | Ratio in Tensile Strength | Ratio in Wear Resistance | Ratio in Static Resistance | Ratio in Water Absorption Rate | Washing Resistance |
|---|---|---|---|---|---|---|---|---|---|---|
| Cotton | Example 1 | Low-substituted | — | 0.18 | 0.01 | 1.1 | 48 | 0.08 | 1.2 | ◎ |
| | Example 2 | Hydroxypropyl | — | 0.26 | 0.02 | 1.1 | 42 | 0.06 | 1.3 | ◎ |
| | Example 3 | Cellulose | — | 0.35 | 0.03 | 1.1 | 45 | 0.07 | 1.3 | ◎ |
| | Example 4 | | — | 0.51 | 0.04 | 1.1 | 37 | 0.05 | 1.4 | ◎ |
| | Example 5 | Low-substituted Methyl Cellulose | 0.22 | — | 0.1 | 1.1 | 23 | 0.07 | 1.1 | ◎ |
| | Example 6 | Low-substituted Hydroxy-propylmethyl Cellulose | 0.15 | 0.12 | 0.07 | 1.2 | 32 | 0.07 | 1.4 | ◎ |
| Wool | Example 7 | Low-substituted | — | 0.18 | 0.02 | 1.2 | 40 | 0.07 | 1.2 | ◎ |
| | Example 8 | Hydroxypropyl Cellulose | — | 0.26 | 0.03 | 1.3 | 37 | 0.07 | 1.3 | ◎ |
| | Example 9 | Low-substituted | — | 0.26 | 0.04 | 1.2 | 28 | 0.06 | 1.3 | ◎ |
| | Example 10 | Hydroxypropyl Cellulose | — | 0.26 | 0.01 | 1.3 | 45 | 0.04 | 1.3 | ◎ |
| Poly-ester/ Wool | Example 11 | Low-substituted | — | 0.18 | 0.3 | 1.2 | 10 | 0.03 | 2.1 | ◎ |
| | Example 12 | Hydroxypropyl | — | 0.26 | 0.2 | 1.3 | 15 | 0.02 | 1.8 | ◎ |
| | Example 13 | Cellulose | — | 0.35 | 0.2 | 1.1 | 10 | 0.01 | 1.7 | ◎ |

Japanese Patent Application Nos. 2004-192517, 2005-045206 and 2005-169335 are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for modifying fibers consisting essentially of the steps of:

dispersing a cellulose ether having such a low degree of substitution that a molar degree of substitution with an alkyl group and/or a hydroxyalkyl group ranges from 0.05 to 1.3 in water, or an aqueous solution of an alkali and adjusting the concentration of alkali if the aqueous solution has a concentration of an alkali greater than 1% by weight, to produce a dilute alkali aqueous solution having a concentration of an alkali of 1% by weight or less, which is a dispersion to be sheared, shearing the dispersion to be sheared under shear force to produce a sheared dispersion, applying a combined composition of the resulting sheared dispersion and a crosslinking agent or an aqueous resin emulsion to said fibers, and thermally treating the dispersion-applied fibers;

wherein the fibers are selected from the group consisting of wool, silk, cashmere, and blends of polyesters and wool.

2. The method for modifying fibers according to claim 1, wherein the cellulose ether is dissolved in said aqueous solution of an alkali, and the solution is neutralized with an equivalent of an acid or such an amount of an acid that the solution having a concentration of an alkali of 1% by weight or less is obtained, thereby settling the cellulose ether to prepare the dispersion to be sheared.

3. The method for modifying fibers according to claim 1, wherein the dispersion is prepared by a method wherein dispersed particles in said dispersion are caused to mutually collide or to collide against a collision plate for grinding, using a vibration ball mill, colloid mill, homomixer or homogenizer.

4. The method for modifying fibers according to claim 1, wherein a low-substituted cellulose ether dispersion to be sheared is injected from a nozzle with a pressure of 70 to 250 MPa so that the low-substituted cellulose ether dispersion to be sheared is caused to mutually collide or collide against a collision plate with an angle of collision of 90 to 180° and the number of collision of 1 to 200 sufficient to cause the particles of the low-substituted cellulose ether to be so fine that an average length thereof is reduced at ¼ or below, thereby obtaining the sheared low-substituted cellulose ether dispersion.

5. The method for modifying fibers according to claim 1, wherein particles of the cellulose ether are ground by milling a low-substituted cellulose ether dispersion to be sheared with a shear force of at least 500 $sec^{-1}$ one time to 60 times, thereby obtaining the sheared low-substituted cellulose ether dispersion.

6. A method for modifying fibers consisting essentially of the steps of:

dissolving a cellulose ether having such a low degree of substitution that a molar degree of substitution with an alkyl group and/or a hydroxyalkyl group ranges from 0.05 to 1.3 in an alkali aqueous solution having a concentration of an alkali of 2 to 25% by weight, the alkali solution is then milled under shear by means of a colloid mill or ground through collision by use of a homogenizer while the solution is neutralized to a concentration of an alkali of 1% by weight or less, thereby obtaining a sheared dispersion, applying a combined composition of the sheared dispersion and a crosslinking agent or an aqueous resin emulsion to said fibers, and thermally treating the dispersion-applied fibers;

wherein the fibers are selected from the group consisting of wool, silk, cashmere, and blends of polyesters and wool.

7. The method of modifying fibers according to claim 1, wherein the concentration of the cellulose ether in the dispersion ranges from 0.5 to 20% by weight, and the dispersion is applied to said fibers in such an amount that a pickup ranges 10 to 500% by weight.

8. A method for modifying fibers consisting essentially of the steps of:

dispersing a cellulose ether having such a low degree of substitution that a molar degree of substitution with an alkyl group and/or a hydroxyalkyl group ranges from 0.05 to 1.3 in water or an aqueous solution of an alkali and adjusting the concentration of alkali, if the aqueous solution has a concentration of an alkali greater than 1% by weight, to produce a dilute alkali aqueous solution having a concentration of an alkali of 1% by weight or less which is a dispersion to be sheared, shearing the dispersion to be sheared under shear force to produce a sheared dispersion, applying a combined composition of the resulting sheared dispersion and a crosslinking agent or an aqueous resin emulsion to said fibers, and thermally treating the dispersion-applied fibers;

wherein said crosslinking agent is a polyfunctional isocyanate compound having more than one isocyanate group in a molecule.

9. The method for modifying fibers according to claim 1, wherein said aqueous resin emulsion is an aqueous urethane resin emulsion or an oil-in-water emulsion of a reactive organopolysiloxane.

10. A method for modifying fibers consisting essentially of the steps of:

dispersing a cellulose ether having such a low degree of substitution that a molar degree of substitution with an alkyl group and/or a hydroxyalkyl group ranges from 0.05 to 1.3 in water or an aqueous solution of an alkali and adjusting the concentration of alkali, if the aqueous solution has a concentration of an alkali greater than 1% by weight, to produce a dilute alkali aqueous solution having a concentration of an alkali of 1% by weight or less which is a dispersion to be sheared, shearing the dispersion to be sheared under shear force to produce a sheared dispersion, applying a combined composition of the resulting sheared dispersion and a crosslinking agent or an aqueous resin emulsion to said fibers, and thermally treating the dispersion-applied fibers;

wherein said cellulose ether is a low-substituted hydroxypropyl cellulose having a molar degree of substitution of from 0.1 to 0.7.

11. The method for modifying fibers according to claim 1, wherein the thermal treatment after the crosslinking agent is applied is conducted at a temperature of 100 to 170° C. for 1 to 20 minutes.

12. The method for modifying fibers according to claim 1, wherein the thermal treatment after the aqueous resin emulsion is applied is conducted at a temperature of 80 to 150° C. for 1 to 20 minutes.

13. The method for modifying fibers according to claim 9, wherein the particle size in said oil-in-water emulsion of a reactive organopolysiloxane is within a range of from 0.01 to 100 μm.

14. The method for modifying fibers according to claim 9, wherein the particle size in said oil-in-water emulsion of a reactive organopolysiloxane is within a range of from 0.1 to 80 μm.

15. The method according to claim 8, wherein said polyfunctional isocyanate compound is at least one selected from the group consisting of toluidine isocyanate, dimer of 2,4-toluidine isocyanate, naphthylene-1,5-diisocyanate, o-toluidine isocyanate, diphenylmethane diisocyanate, triphenylmethane triisocyanate, tris(p-isocyanatephenyl) thiophosphite, polymethylenepolyphenyl isocyanate, polyfunctional aromatic isocyanates, aromatic polyisocyanates, hexamethylene diisocyanate, trimethylhexamethylene diisocyanate, isophorone diisocyanate, blocked polyisocyanates, xylylene diisocyanate, ether group and urethane group-bearing, blocked isocyanate-containing prepolymers, polyisocyanate prepolymers, blocked isocyanates, polyisocyanates, two-component polyisocyanates, yellowing-free, two-component polyisocyanates, and thermosetting polyisocyanates.

16. The method for modifying fibers according to claim 1, wherein the crosslinking agent reacts with hydroxyl groups left in the molecule of the cellulose ether so that a crosslinking reaction is caused.

* * * * *

UNITED STATES PATENT AND TRADEMARK OFFICE

CERTIFICATE OF CORRECTION

PATENT NO. : 7,803,196 B2
APPLICATION NO. : 11/168418
DATED : September 28, 2010
INVENTOR(S) : Naosuke Maruyama et al.

It is certified that error appears in the above-identified patent and that said Letters Patent is hereby corrected as shown below:

ON THE TITLE PAGE:

At item (73), Assignees, change:

"Aichi Prefectural Government, Nagoya-Shi (JP); Ichinomy Fashion Design Center Foundation, Ichinomiya-Shi (JP); Shin-Etsu Chemical Co., Ltd., Tokyo (JP)"

To

-- Aichi Prefectural Government, Nagoya-Shi (JP); Ichinomiya Fashion Design Center Foundation, Ichinomiya-Shi (JP); Shin-Etsu Chemical Co., Ltd., Tokyo (JP) --.

Signed and Sealed this
Eleventh Day of January, 2011

David J. Kappos

David J. Kappos
*Director of the United States Patent and Trademark Office*